US007883825B2

(12) United States Patent
Akioka

(10) Patent No.: US 7,883,825 B2
(45) **Date of Patent: *Feb. 8, 2011**

(54) IMAGE FORMING APPARATUS AND METHOD FOR FORMING AN IMAGE ON A RECORDING MEDIUM

(75) Inventor: Koji Akioka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1129 days.

This patent is subject to a terminal disclaimer.

(21) Appl. No.: 11/537,109

(22) Filed: Sep. 29, 2006

(65) Prior Publication Data

US 2007/0071501 A1 Mar. 29, 2007

(30) Foreign Application Priority Data

Sep. 29, 2005 (JP) ..... 2005-285405

(51) Int. Cl.
*G03G 13/10* (2006.01)

(52) U.S. Cl. ..... 430/117.4; 430/117.5; 430/118.6

(58) Field of Classification Search ..... 430/137.22, 430/114, 115, 116, 117.5, 117.4, 117.3, 118.6, 430/118.7, 117.2; 399/237
See application file for complete search history.

(56) References Cited

U.S. PATENT DOCUMENTS 6,539,191 B2 * 3/2003 Itaya ..... 430/45.2
7,563,550 B2 * 7/2009 Akioka et al. ..... 430/112
7,670,732 B2 * 3/2010 Miura et al. ..... 430/45.2
2005/0078984 A1 * 4/2005 Fujita et al. ..... 399/249
2006/0188803 A1 * 8/2006 Yabuki et al. ..... 430/117
2006/0204884 A1 * 9/2006 Teshima ..... 430/114
2006/0234150 A1 * 10/2006 Akioka et al. ..... 430/112

FOREIGN PATENT DOCUMENTS

JP 2000-162829 * 6/2000
JP 2004-286859 10/2004

OTHER PUBLICATIONS

Diamond, A.S., ed., Handbook of Imaging Materials, Marcel Dekker, Inc., NY (1991), p. 160-161.*
Japanese Patent Office machine-assisted translation of JP 2000-162829 (pub. Jun. 2000).*

* cited by examiner

*Primary Examiner*—Janis L Dote
(74) *Attorney, Agent, or Firm*—DLA Piper LLP (US)

(57) ABSTRACT

An image forming apparatus which forms an image onto a recording medium using a liquid developer which contains an insulation liquid and toner particles dispersed in the insulation liquid is provided. The image forming apparatus includes a liquid developer storage section for storing the liquid developer therein; a developing section for developing a toner image using the liquid developer supplied from the liquid developer storage section; an image transfer section for transferring the developed toner image formed by the developing section onto the recording medium to form a transferred image thereon; and a fixing section for fixing the transferred image formed on the recording medium onto the recording medium, wherein at least a part of the insulation liquid in the transferred image is oxidized and polymerized to fix the toner particles in the transferred image onto the recording medium. According to the image forming apparatus, it is possible to fix the toner particles onto the recording medium firmly. A method for forming an image onto a recording medium using the liquid developer is also provided.

6 Claims, 4 Drawing Sheets

IMAGE FORMING APPARATUS AND METHOD FOR FORMING AN IMAGE ON A RECORDING MEDIUM

CROSS-REFERENCE TO RELATED APPLICATION

This application claims priority to Japanese Patent Application No. 2005-285405 filed on Sep. 29, 2005 which is hereby expressly incorporated by reference herein in its entirety.

BACKGROUND OF THE INVENTION

1. Field of the Invention

The present invention relates to an image forming apparatus and a method for forming an image on a recording medium.

2. Description of the Prior Art

There is known an image forming apparatus for forming an image using a liquid developer containing an insulation liquid and toner particles dispersed in the insulation liquid.

In a developing method using the liquid developer, since aggregation of toner particles in the liquid developer is effectively prevented as compared to a developing method using a dry toner in which solid state toner particles are used, it is possible to use very fine toner particles and it is also possible to use a binder resin having a low softening point (a low softening temperature). As a result, the image forming apparatus using the liquid developer has such advantages as good reproductivity of an image composed of thin lines, good tone reproductivity as well as good reproductivity of colors.

Generally, petroleum-based hydrocarbons, silicone oils and the like are used as an insulation liquid contained in the liquid developer due to their high chemical stability.

However, in the image forming apparatus using the liquid developer, there is a problem in that an insulation liquid that has adhered to surfaces of toner particles during a fixing process infiltrates into a recording medium, whereby lowering fixing strength of the toner particles. In addition to this, there is also a problem in that it becomes difficult to write letters or the like onto the recording medium with a ballpoint pen or the like due to this infiltration of the insulation liquid.

In order to solve such problems, there has been an attempt to remove an insulation liquid using a squeeze roller or the like before transferring toner particles onto a recording medium (see JP-A 2004-286859, for example).

However, in such a method, it is difficult to remove an insulation liquid sufficiently to obtain sufficient fixing strength of toner particles. Although, instead of this method, it can also be possible to fix toner particles onto a recording medium by heating them with a relatively high temperature for a long time, it is difficult to satisfy demands for speed-up and energy-saving in recent image forming technology.

SUMMARY OF THE PRESENT INVENTION

Accordingly, it is an object of the present invention to provide an image forming apparatus that makes it possible to fix toner particles onto a recording medium firmly. Further, it is also an object of the present invention to provide a method for forming an image on a recording medium.

In order to achieve these above objects, one aspect of the present invention is directed to an image forming apparatus for forming an image onto a recording medium using a liquid developer containing an insulation liquid and toner particles dispersed in the insulation liquid. The image forming apparatus includes a developing section for developing a toner image using the liquid developer supplied from the liquid developer storage section; an image transfer section for transferring the developed toner image formed by the developing section onto the recording medium to form a transferred image thereon; and an image transfer section for transferring the developed latent image formed on the photoreceptor onto the recording medium to form a transferred image thereon, and a fixing section for fixing the transferred image formed on the recording medium onto the recording medium, wherein at least a part of the insulation liquid in the transferred image is oxidized and polymerized at the fixing section to fix the toner particles in the transferred image onto the recording medium.

According to the invention described above, it is possible to provide an image forming apparatus which can fix the toner image onto the recording medium firmly.

In the image forming apparatus according to the present invention, it is preferred that the insulation liquid constituting the liquid developer stored in the liquid developer storage section contains an unsaturated fatty acid component. This makes it possible to accelerate the oxidation polymerization reaction of the insulation liquid during the fixing process effectively at a relatively low temperature.

In the image forming apparatus according to the present invention, it is preferred that the fixing section includes an ultraviolet irradiation means. The ultraviolet irradiation means makes it possible to accelerate the oxidation polymerization reaction of the insulation liquid in an unfixed image more effectively. As a result, it is possible to fix the toner particles onto the recording medium more reliably as well as to form the image at higher speed.

In the image forming apparatus according to the present invention, it is preferred that an amount of the toner particles contained in the liquid developer stored in the liquid developer storage section is in the range of 20 to 60 wt %. This makes it possible to fix the toner particles onto the recording medium more effectively.

In the image forming apparatus according to the present invention, it is preferred that when $L_2$ represents a length of the toner particle in a long axis direction thereof and $L_3$ represents a length of the toner particle in a short axis direction thereof in two-dimensional view the relation of $1.00 \leqq L_2/L_3 \leqq 1.40$ is satisfied, and wherein an average roundness R represented by the following formula (I) of the toner particles in the insulation liquid constituting the liquid developer stored in the liquid developer storage section is 0.94 to 0.99;

$$R = L_0/L_1 \quad \text{(I)}$$

where $L_1$ (μm) represents the circumference of projected image of a toner particle that is a subject of measurement, and $L_0$ (μm) represents the circumference of a perfect circle having the same area as that of the projected image of the toner particle.

According to this, an appropriate amount of the insulation liquid can be contained in the unfixed image that has been transferred onto the recording medium, whereby the fixing strength of the toner particles can be made further higher.

In the image forming apparatus according to the present invention, it is preferred that the image forming apparatus further comprises a liquid amount adjusting means for adjusting an amount of the insulation liquid in the transferred image. The liquid amount adjusting means can adjust the amount of the insulation liquid in the transferred image on the recording medium so as to be more appropriate one so that the fixing strength of the toner particles can be made further higher.

In the image forming apparatus according to the present invention, it is preferred that when $W_1$ [g] represents the amount of the toner particles in the transferred image and $W_2$ [g] represents the amount of the insulation liquid in the transferred image, a relation of $0.25 \leqq W_2/W_1 \leqq 1$ is satisfied. This makes it possible to fix the toner particles onto the recording medium more firmly in the fixing section.

In the image forming apparatus according to the present invention, it is preferred that the insulation liquid stored in the insulation liquid storage section contains an oxidation polymerization accelerator for accelerating oxidation polymerization reaction of the insulation liquid during a fixing process. The oxidation polymerization accelerator can accelerate the oxidation polymerization reaction (curing reaction) of the insulation liquid effectively during the fixing process.

In the image forming apparatus according to the present invention, it is preferred that the oxidation polymerization accelerator is a metal salt of fatty acid. This makes it possible to accelerate the oxidation polymerization reaction of the insulation liquid during the fixing process effectively while maintaining the storage stability of the liquid developer in the liquid developer storage section more reliably.

In the image forming apparatus according to the present invention, it is preferred that the amount of the oxidation polymerization accelerator contained in the liquid developer is in the range of 0.01 to 15 parts by weight with respect to 100 parts by weight of the insulation liquid. This makes it possible to accelerate the oxidation polymerization reaction more effectively during the fixing process while preventing the oxidation polymerization reaction of the insulation liquid from being caused in the liquid developer storage section more reliably.

In the image forming apparatus according to the present invention, it is preferred that the oxidation polymerization accelerator is contained in the insulation liquid with being encapsulated. By using the oxidation polymerization accelerator with being encapsulated, it is possible to prevent oxidation polymerization reaction from being caused during the storage or preservation of the liquid developer more reliably. Further, since the capsules of the oxidation polymerization accelerator are collapsed with a predetermined pressure applied at the fixing process, it is possible to accelerate the oxidation polymerization reaction of the insulation liquid reliably.

In the image forming apparatus according to the present invention, it is preferred that the liquid developer stored in the liquid developer storage section contains an antioxidizing agent. This makes it possible to accelerate the oxidation polymerization reaction of the insulation liquid effectively during the fixing process while maintaining the storage stability of the liquid developer in the liquid developer storage section more reliably.

In the image forming apparatus according to the present invention, it is preferred that a pyrolysis temperature of the antioxidizing agent is equal to or less than a fixing temperature of the fixing process. This makes it possible to prevent deterioration of the insulation liquid in the liquid developer storage section and the like effectively. Further, this also makes it possible to thermally decompose the antioxidizing agent contained in the insulation liquid adhering to the surfaces of the toner particles during the fixing process so as to cure (oxidize and polymerize) the insulation liquid effectively. As a result, the fixing characteristics of the toner particles onto the recording medium can be made particularly excellent.

Another aspect of the present invention is directed to a method for forming an image onto a recording medium using a liquid developer containing an insulation liquid and toner particles dispersed in the insulation liquid. The method comprising the steps of: supplying the liquid developer stored in a liquid developer storage section for developing a toner image; developing the toner image using the supplied liquid developer; transferring the developed toner image onto the recording medium to form a transferred image thereon; and fixing the transferred image formed on the recording medium, wherein at least a part of the insulation liquid in the transferred image is oxidized and polymerized when fixing the transferred toner image to fix the toner particles in the transferred image onto the recording medium.

According to the invention mentioned above, it is possible to fix the toner image onto the recording medium firmly.

In the method mentioned above, it is preferred that the insulation liquid constituting the liquid developer stored in the liquid developer storage section contains an unsaturated fatty acid component. This makes it possible to accelerate the oxidation polymerization reaction of the insulation liquid during the fixing process effectively at a relatively low temperature.

Further, in the method mentioned above, it is also preferred that the method further comprises the step of irradiating the transferred toner image on the recording medium with ultraviolet rays. The ultraviolet irradiation makes it possible to accelerate the oxidation polymerization reaction of the insulation liquid in an unfixed image more effectively. As a result, it is possible to fix the toner particles onto the recording medium more reliably as well as to form the image at higher speed.

Furthermore, in the method mentioned above, it is also preferred that the liquid developer stored in the liquid developer storage section contains an oxidation polymerization accelerator for accelerating oxidation polymerization reaction of the insulation liquid during a fixing process. The oxidation polymerization accelerator can accelerate the oxidation polymerization reaction (curing reaction) of the insulation liquid effectively during the fixing process.

Moreover, in the method mentioned above, it is also preferred that the oxidation polymerization accelerator is contained in the insulation liquid with being encapsulated. By using the oxidation polymerization accelerator with being encapsulated, it is possible to prevent oxidation polymerization reaction from being caused during the storage or preservation of the liquid developer more reliably. Further, since the capsules of the oxidation polymerization accelerator are collapsed with a predetermined pressure applied at the fixing process, it is possible to accelerate the oxidation polymerization reaction of the insulation liquid reliably.

Moreover, in the method mentioned above, it is also preferred that the liquid developer stored in the liquid developer storage section contains an antioxidizing agent. This makes it possible to accelerate the oxidation polymerization reaction of the insulation liquid effectively during the fixing process while maintaining the storage stability of the liquid developer in the liquid developer storage section more reliably.

Moreover, in the method mentioned above, it is also preferred that a pyrolysis temperature of the antioxidizing agent is equal to or lower than a fixing temperature of the fixing process. This makes it possible to prevent deterioration of the insulation liquid in the liquid developer storage section and the like effectively. Further, this also makes it possible to thermally decompose the antioxidizing agent contained in the insulation liquid adhering to the surfaces of the toner particles during the fixing process so as to cure (oxidize and polymerize) the insulation liquid effectively. As a result, the fixing characteristics of the toner particles onto the recording medium can be made particularly excellent.

These and other objects, structures and effects of the present invention will be more apparent when the following detailed description of the preferred embodiments and the examples will be considered taken in conjunction with the appended drawings.

DETAILED DESCRIPTION OF THE PREFERRED EMBODIMENTS

Hereinbelow, with reference to the accompanying drawings, preferred embodiments of an image forming apparatus according to the present invention will be described in detail.

<<Image Forming Apparatus>>

The image forming apparatus of the present invention forms an image onto a recording medium using a liquid developer containing an insulation liquid and toner particles dispersed in the insulation liquid. The insulation liquid contains a component which can be oxidized and polymerized during a fixing process.

Figure 1:
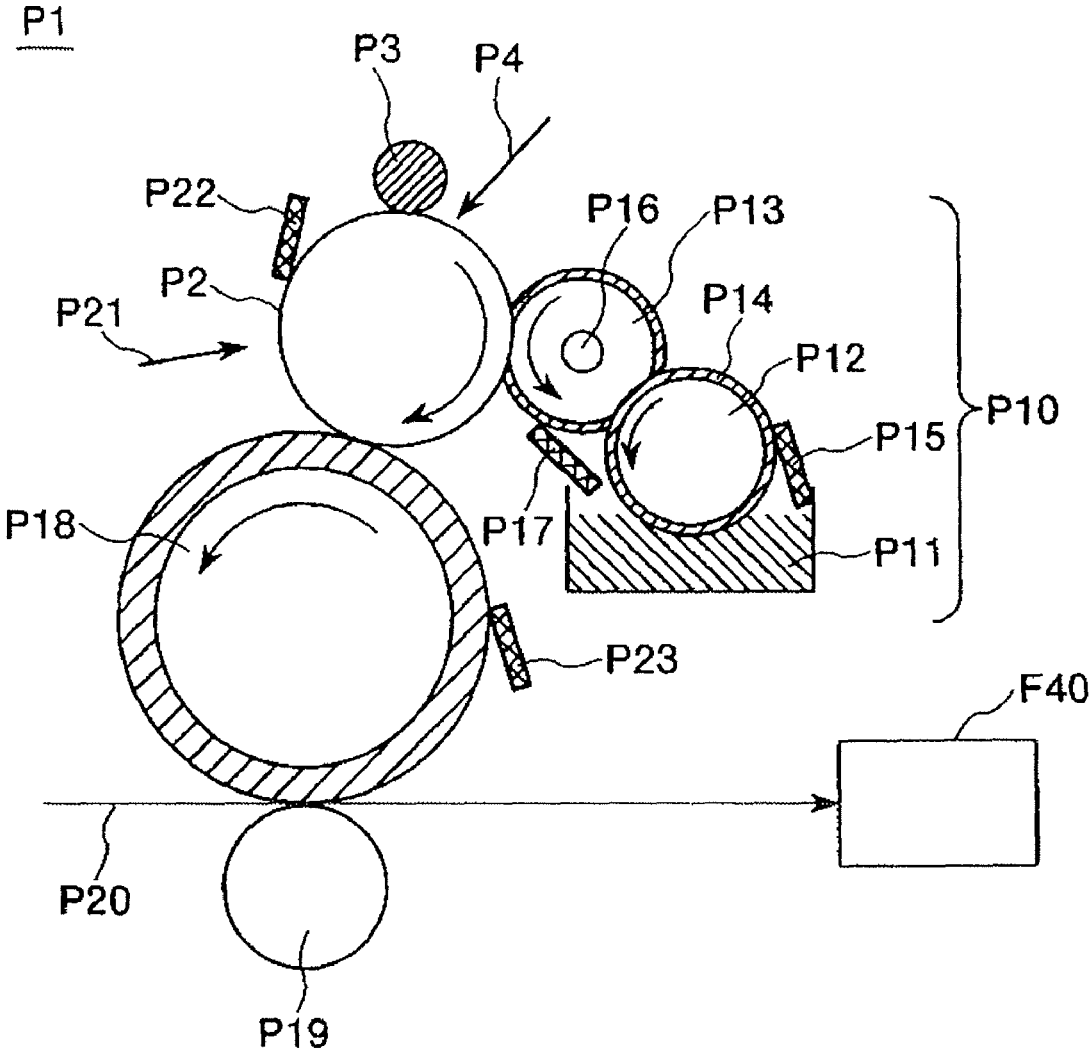
FIG. 1 is a cross-sectional view of one example of a contact type image forming apparatus.

FIG. 1 is an illustration which shows one example of a contact type image forming apparatus of the present invention. The image forming apparatus P1 includes a developer container (a liquid developer storage section) P11 for storing a liquid developer, a photoreceptor (a developing section) P2 in the form of a cylindrical drum for developing an image (a toner image), a developer P10 for supplying the liquid developer from the developer container P11 to the photoreceptor P2, an intermediate transfer roller (an image transfer section) P18 for transferring an image developed on the photoreceptor P2 to a recording medium, and a fixing unit (a fixing section) F40 for fixing the transferred image onto the recording medium.

After the surface of the photoreceptor P2 is uniformly charged with a charging device P3 made of an epichlorohydrin rubber or the like, exposure P4 corresponding to information to be recorded is carried out using a laser diode or the like so that an electrostatic latent image is formed.

The developer P10 has an application roller P12 a part of which is immersed in the developer container P11 and a development roller P13. The application roller P12 is formed from, for example, a gravure roller made of stainless steel or the like, which rotates with opposing to the development roller P13. On the surface of the application roller P12, a liquid developer application layer P14 is formed, and the thickness of the layer is adapted to be kept constant by a metering blade P15.

Further, a liquid developer is transferred from the application roller P12 to the development roller P13. The development roller P13 is constructed from a metallic roller core member P16 made from stainless steel or the like, a low hardness silicone rubber layer provided on the metallic core member P16, and a resin layer made of a conductive PFA (polytetrafluoroetylene-perfluorovinylether copolymer) formed on the silicone rubber layer. The development roller P13 is adapted to rotate at the same speed as the photoreceptor P2 to transfer the liquid developer to a latent image section. A part of the liquid developer remaining on the development roller P13 after it has been transferred to the photoreceptor P2 is removed by the a development roller cleaning blade P17 and then collected in the developer container P11.

Further, after a toner image is transferred from the photoreceptor to the intermediate transfer roller P18, the photoreceptor P2 is discharged with discharging light P21, and a toner which has not been transferred and remains on the photoreceptor P2 is removed by a cleaning blade P22 made of a urethane rubber or the like.

In a similar manner, a toner which is not transferred and remains on the intermediate transfer roller P18 after the toner image has been transferred to an information recording medium P20 is removed by a cleaning blade P23 made of a urethane rubber or the like.

The toner image formed on the photoreceptor P2 is transferred to the intermediate transfer roller P18. Then, a transfer current is supplied to a secondary transfer roller P19, and the toner image transferred on the intermediate roller P18 is transferred onto the recording medium P20 such as a paper which passes between the intermediate transfer roller P18 and the secondary transfer roller P19. Thereafter, the toner image transferred on the recording medium P20 is fixed thereto using the fixing unit F40 which will be described later.

Figure 2:
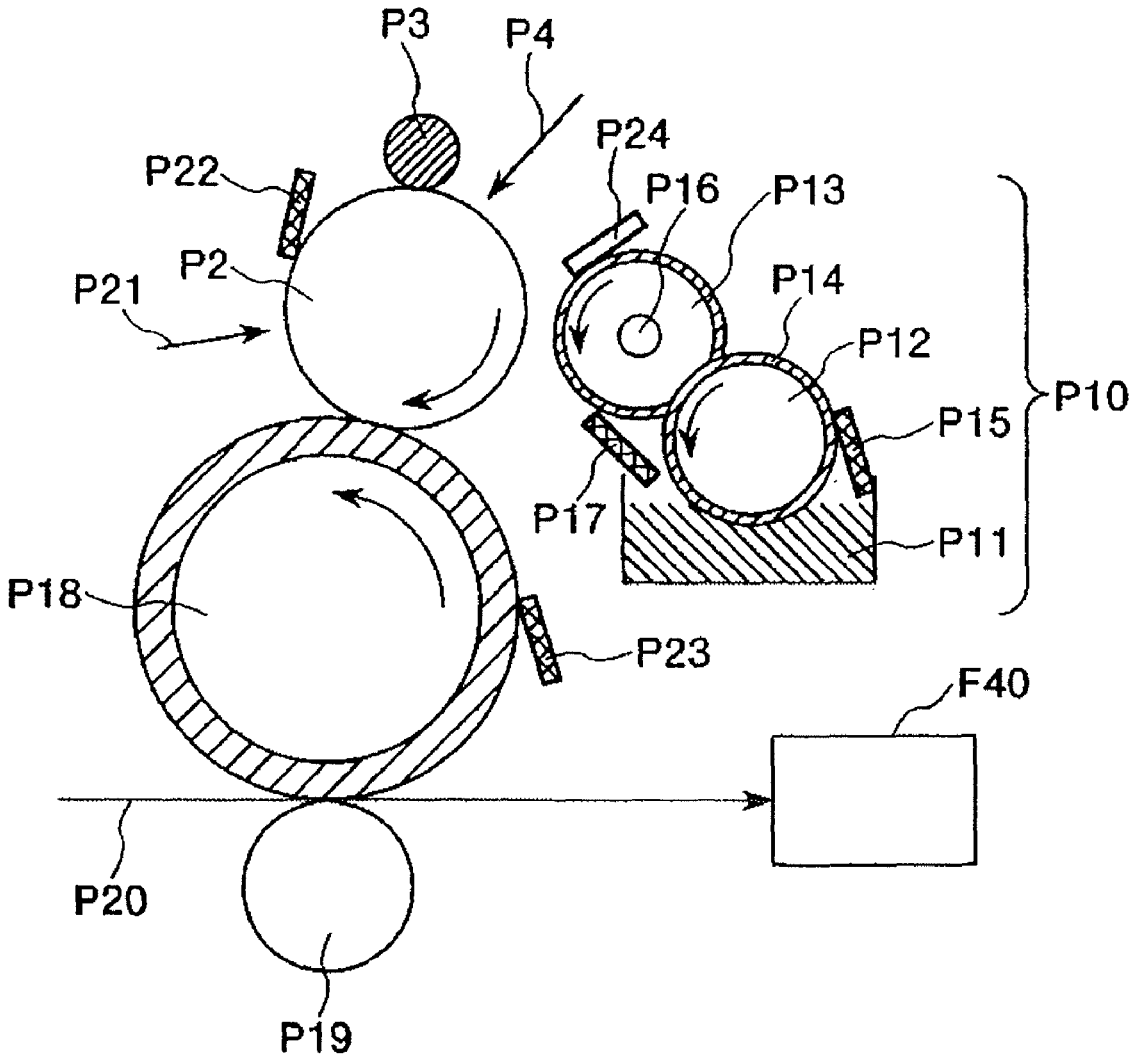
FIG. 2 is a cross-sectional view of one example of a non-contact type image forming apparatus.

FIG. 2 shows one example of a non-contact type image forming apparatus of the present invention. In such a non-contact type image forming apparatus, a development roller P13 is provided with a charging blade P24 which is formed from a phosphor-bronze plate having a thickness of 0.5 mm. The charging blade P24 has a function of causing a layer of the liquid developer to be frictionally charged by contacting it. Further, since the application roller P12 is a gravure roller, a layer of a developer having irregularities corresponding to irregularities on the surface of the gravure roller is formed on the development roller P13. The charging blade P24 also has a function of uniforming the irregularities formed on the development roller P13. The orientation of the charging blade P24 may either be a counter direction or a trail direction with respect to the rotational direction of the development roller P13. Further, the charging blade P24 may be in the form of a roller not a blade.

Preferably, between the development roller P13 and the photoreceptor P2, there is formed a gap whose width is 200 μm to 800 μm, and an AC voltage of 500 to 3000 Vpp and of a frequency of 50 to 3000 Hz which is superimposed on a DC voltage of 200 to 800 V is applied across the development roller P13 and the photoreceptor P2. Other structures of this non-contact type image forming apparatus are the same as those of the contact type image forming apparatus shown in FIG. 1.

In the foregoing, the description was made with regard to the image formation by the embodiments shown in FIGS. 1 and 2 in which a liquid developer of one color is used. However, it goes without saying that when an image is formed using color toners of a plurality of colors, a color image can be formed by using a plurality of development apparatuses corresponding to the respective colors to form images of the respective colors.

Figure 4:
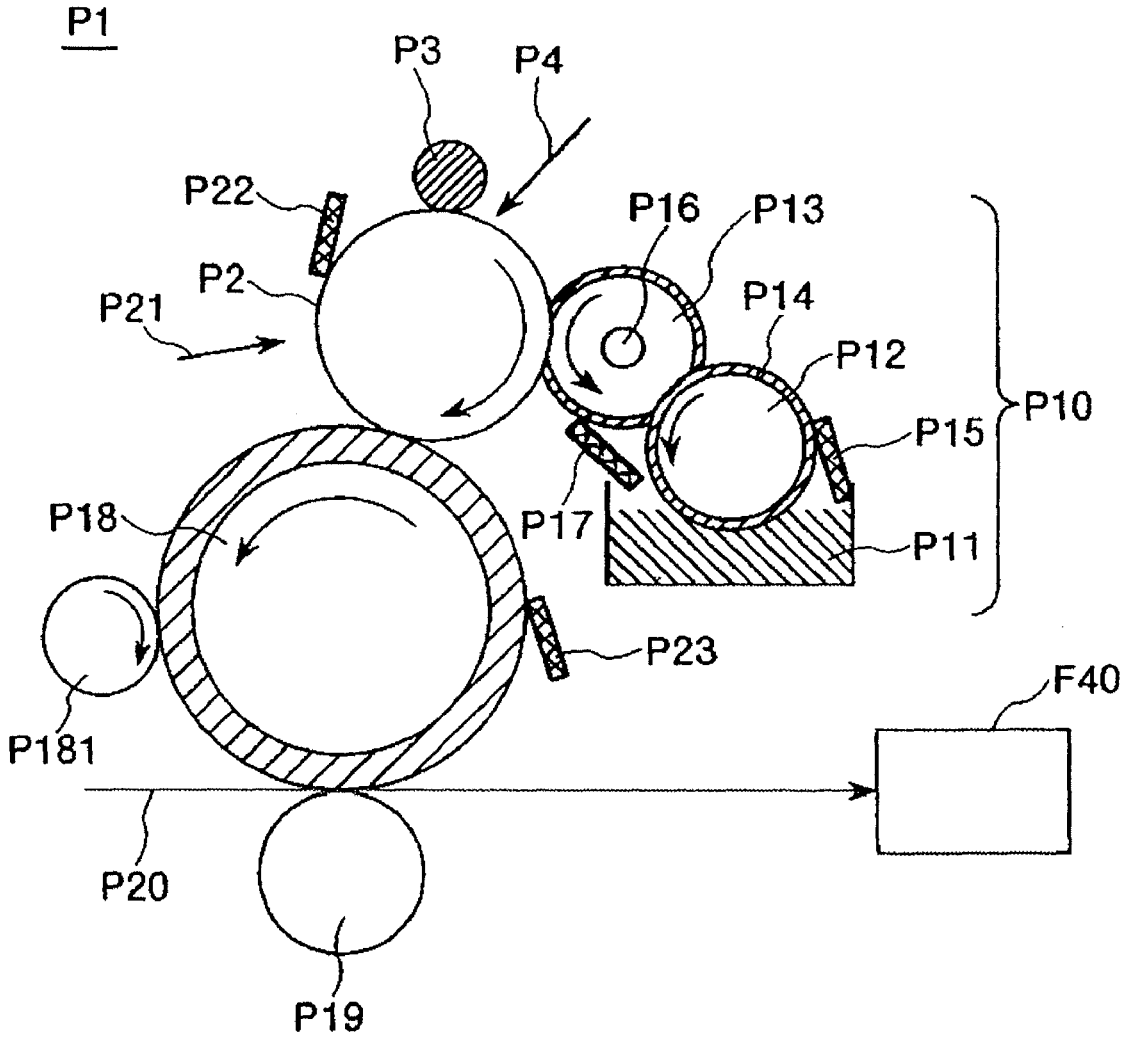
FIG. 4 is a cross-sectional view of another example of an image forming apparatus according to the present invention.

Further, the intermediate transfer roller P18 may be provided with a liquid amount adjusting means for adjusting an amount of an insulation liquid contained in a toner image to be transferred to the recording medium P20. The liquid amount adjusting means can adjust the amount of the insulation liquid contained in the toner image to be transferred to the recording medium P20 to be an appropriate value, and as a result, the fixing strength of the fixed toner particles can be made higher. Examples of such a liquid amount adjusting means include a regulating roller P181 shown in FIG. 4.

In this connection, when $W_1$ [g] represents the amount of the toner particles transferred onto the recording medium P20 and $W_2$ [g] represents the amount of the insulation liquid, it is preferred that the relation of $0.25 \leqq W_2/W_1 \leqq 1$ is satisfied, and more preferred that the relation of $0.4 \leqq W_2/W_1 \leqq 1$ is satisfied. By satisfying such a relation, the toner particles can be fixed onto the recording medium P20 more firmly in the fixing unit F40 which will be described later.

Figure 3:
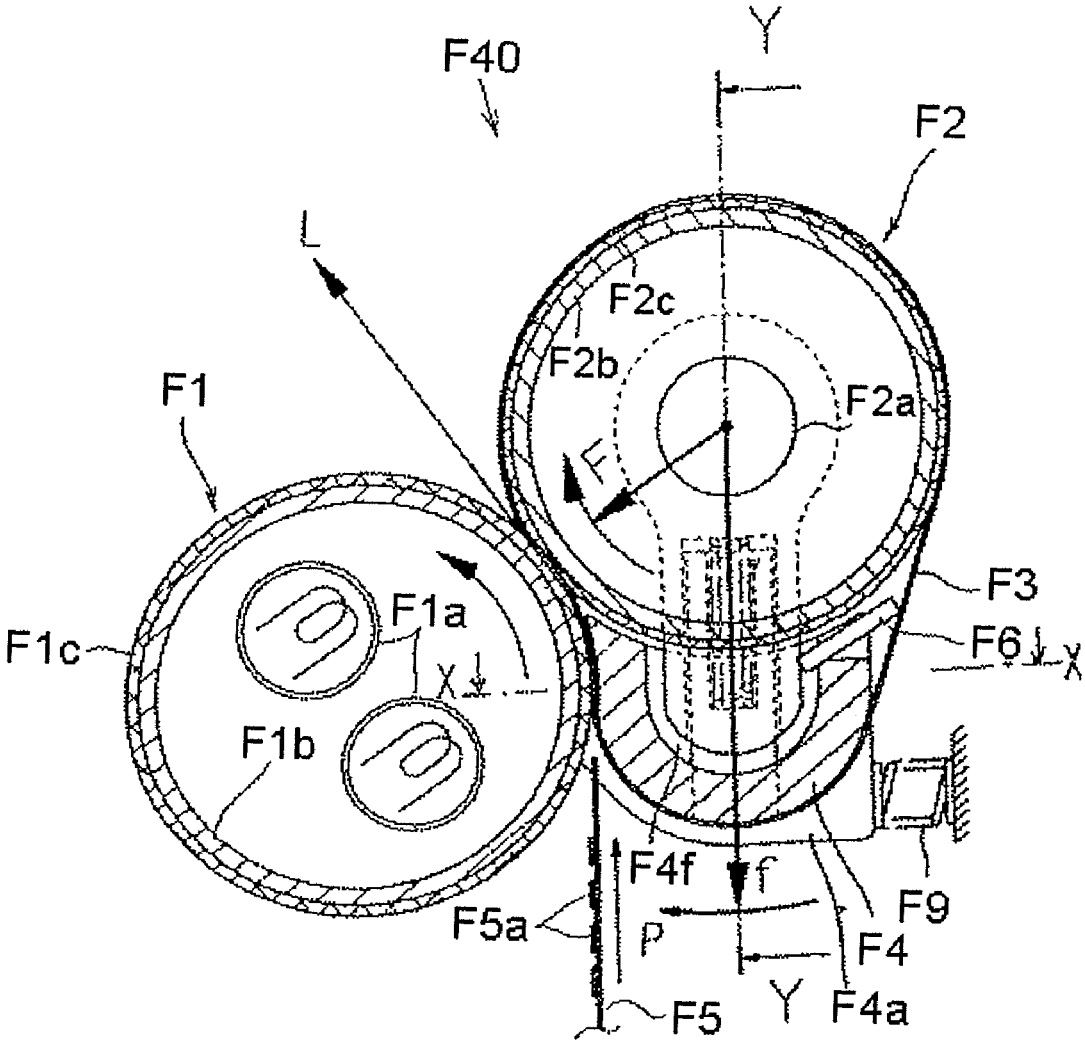
FIG. 3 is a cross-sectional view of one example of a fixing section of an image forming apparatus according to the present invention.

FIG. 3 is a cross-sectional view of a fixing section (a fixing unit), in which F1 is a heat fixing roller, F1*a* are halogen lamps, F1*b* is a roller base, F1*c* is an elastic body, F2 is a pressure roller, F2*a* is a rotation shaft, F2*b* is a roller base, F2*c* is an elastic body, F3 is a heat resistant belt, F4 is a belt tension member, F4*a* is a protruding wall, F5 is a sheet material, F5*a* is an unfixed toner image, F6 is a cleaning member, F7 is a frame, F9 is a spring, and L is a tangential line of a pressing part.

As shown in this figure, the fixing unit F40 includes the heat fixing roller (hereinafter, also referred to as "heat fuser roller") F1, the pressure roller F2, the heat resistant belt F3, the belt tension member F4, and the cleaning member F6.

The heat fixing roller F1 has the roller base F1*b* formed from a pipe member having an outer diameter of about 25 mm and a thickness of about 0.7 mm. The roller base F1*b* is coated with the elastic body F1*c* having a thickness of about 0.4 mm. Further, inside the roller base F1*b*, two halogen lamps F1*a*, F1*a* which act as a heat source are provided. Each of the halogen lamps F1*a* has a tubular shape and an output of 1,050 W. The heat fixing roller F1 is rotatable in an anticlockwise direction shown by the arrow in FIG. 3. Further, the pressure roller F2 has the roller base F2*b* formed from a pipe member having an outer diameter of about 25 mm and a thickness of about 0.7 mm. The roller base F2*b* is coated with the elastic body F2*c* having a thickness of about 0.2 mm. The pressure roller F2 having the above structures is rotatable in a clockwise direction indicated by the arrow F in FIG. 3, and it is arranged so as to face the heat fixing roller F1 so that a pressing pressure between the heat fixing roller F1 and the pressure roller F2 becomes 10 kg or less and a nip length therebetween is about 10 mm.

As described above, since each of the heat fixing roller F1 and the pressure roller F2 is formed so as to have a small outer diameter of about 25 mm, there is less possibility that a sheet material F5 after the fixing process is wound around the heat fixing roller F1 or the heat resistant belt F3, and thus it is not necessary to have any means for peeling off the sheet material F5 forcibly. Further, since the PFA layer having a thickness of about 30 μm is provided on the surface of the elastic member F1*c* of the heat fixing roller F1, the strength thereof is improved. By providing such a PFA layer, both the elastic members F1*c* and F2*c* are elastically deformed substantially uniformly though their thicknesses are different from each other, thereby forming a so-called horizontal nip. Further, there is no difference between the circumferential velocity of the heat fixing roller F1 and the conveying speed of the heat resistant belt F3 or the sheet material F5. For these reasons, it is possible to perform an extremely stable image fixation.

Further, as described above, the two halogen lamps F1*a*, F1*a* which act as a heat source are provided inside the heat fixing roller F1. These halogen lamps F1*a*, F1*a* are provided with heating elements, respectively, which are arranged at different positions. With this arrangement, by selectively lighting up any one or both of the halogen lamps F1*a*, F1*a*, it is possible to easily carry out a temperature control under different conditions such as a case where a wide sheet material is used or a narrow sheet material is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The heat resistant belt F3 is a ring-shaped endless belt, and it is wound around the outer circumferences of the pressure roller F2 and the belt tension member F4 so that it can be moved with being held between the heat fixing roller F1 and the pressure roller F2 in a pressed state. The heat resistant belt F3 is formed from a seamless tube having a thickness of 0.03 mm or more. Further, the seamless tube has a two layered structure in which its surface (which is the surface thereof that makes contact with the sheet material F5) is formed of PFA, and the opposite surface thereof (that is, the surface thereof that makes contact with the pressure roller F2 and the belt tension member F4) is formed of polyimide. However, the structure of the heat resistant belt F3 is not limited to the structure described above, it may be formed from other materials. Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the sheet material F5 conveying direction. Further, the belt tension member F4 is pivotally disposed about the rotation shaft F2*a* of the pressure roller F2 so as to be movable along the arrow P. The belt tension member F4 is constructed so that the heat resistant belt F3 is extended with tension in the tangential direction of the heat fixing roller F1 in a state that the sheet material F5 does not pass through the fixing nip part. When the fixing pressure is large at an initial position where the sheet material F5 enters the fixing nip part, there is a case that the sheet material F5 can not enter the fixing nip part smoothly and thereby fixation is performed in a state that a tip part of the sheet material F5 is folded. However, in this embodiment, the belt tension member F4 is provided so that the heat resistant belt F3 is extended with tension in the tangential direction of the heat fixing roller F1 as described above, there is formed an introducing portion for smoothly introducing the sheet material F5, so that the sheet material F5 can be introduced into the fixing nip part in a stable manner.

The belt tension member F4 is a roughly semi-circular member for slidably guiding the heat resistant belt F3 (the heat resistant belt F3 slidably moves on the belt tension member F4). The belt tension member F4 is fitted into the inside of the heat resistant belt F3 so as to impart tension f to the heat resistant belt F3 in cooperation with the pressure roller F2. The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2. The protruding wall F4*a* is formed on any one or both of the end surfaces of the belt tension member F4 which are located in the axial direction thereof. The protruding wall F4 is provided for restricting the heat resistant belt F3 from being off to the side by abutment thereto in a case that the heat resistant belt F3 is deviated in any one of the sides. Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roller F1 in slidably contact with the heat fixing roller F1.

In order to stably drive the heat resistant belt F3 by the pressure roller F2 in a state that the heat resistant belt F3 is wound around the pressure roller F2 and the belt tension member F4, the frictional coefficient between the pressure roller F2 and the heat resistant belt F3 is set to be larger than the frictional coefficient between the belt tension member F4 and the heat resistant belt F3. However, there is a case that these frictional coefficients become unstable due to entrance of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2. With this structure, the distance that the heat resistant belt F3 moves on the belt tension member F4 becomes short so that unstable factors due to deterioration with the lapse of time and disturbance can be avoided or reduced. As a result, it is possible to drive the heat resistant belt F3 with the pressure roller F2 in stable manner.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3. By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

A position where the belt tension member F4 is slightly pressed against the heat fixing roller F1 is set as a nip beginning position and a position where the pressure roller F2 is pressed against the heat fixing roller F1 is set as nip ending position. The sheet material F5 enters the fixing nip part from the nip beginning position and passes through between the heat resistant belt F3 and the heat fixing roller F1, and then fed out from the nip ending position, and during these processes an unfixed toner image F5*a* is fixed on the sheet material F5 and then the sheet material F5 is discharged along the tangential line L of the pressing part between the heat fixing roller F1 and the pressing roller F2.

In the image forming apparatus of the present invention, at least a part of the insulation liquid contained in the unfixed transferred image (toner image) is oxidized and polymerized to thereby fix the toner particles in the unfixed transferred image onto the recording medium during the fixing process. By utilizing the oxidation polymerization reaction of the insulation liquid for fixing the transferred image onto the recording medium as described above, it becomes possible to fix the toner particles onto the recording medium firmly without heating them at a high temperature. Further, since a large amount of heat is not necessary to be applied during the fixing process, it is possible to fix the toner particles onto the recording medium firmly even if the time in which the recording medium passes through the fixing nip part is made relatively short. In other words, since the toner particles can be fixed onto the recording medium in a relatively short time, it is possible to further speed up the printing speed. Furthermore, since a large amount of heat is not necessary for the fixing process, it is also possible to save energy.

In this regard, a liquid developer used in the present invention will be described later in detail.

The time required for the toner particles to pass through the fixing nip part (nip time) is preferably in the range of 0.02 to 0.2 seconds, and more preferably in the range of 0.03 to 0.1 seconds. Even in the case where the nip time is short as above, according to the image forming apparatus of the present invention, it is possible to fix the toner particles onto the recording medium sufficiently and also possible to speed up the printing speed.

Further, the fixing unit F40 is suitable for high speed printing (high speed fixing or high speed image forming). In particular, the feeding speed of the recording medium P20 (the sheet material F5) is preferably in the range of 0.05 to 1.0 m/sec, and more preferably in the range of 0.2 to 0.5 m/sec. In this way, the image forming apparatus of the present invention can prevent poor fixation of the toner particles onto the recording medium from occurring.

The temperature for fixing an unfixed toner image is preferably in the range of 80 to 200° C., and more preferably in the range of 80 to 180° C. When the fixing temperature is in the above range, oxidation polymerization reaction of the insulation liquid can progress more effectively. As a result, it is possible to increase the fixing strength of the toner particles more effectively. Further, in a case where the insulation liquid contains an oxidation polymerization accelerator which will be described later, the oxidation polymerization reaction of the insulation liquid can progress further more effectively.

Further, the fixing part of the image forming apparatus described above may be provided with an ultraviolet irradiation means for irradiating ultraviolet ray to the unfixed toner image on the recording medium. This makes it possible to accelerate the oxidation polymerization reaction of the insulation liquid in the unfixed toner image more effectively. As a result, it becomes possible to fix the toner particles onto the recording medium more reliably and also possible to further speed up image formation.

<<Liquid Developer>>

Next, a liquid developer stored in the liquid developer storage section of the image forming apparatus of the present invention will be described in detail.

A liquid developer used in the image forming apparatus of the present invention includes an insulation liquid and toner particles dispersed in the insulation liquid. The amount of the toner particles contained in the liquid developer stored in the liquid developer storage section is preferably in the range of 20 to 60 wt %. This makes it possible to fix the toner particles onto a recording medium more effectively.

<Toner Particles>

First, a description will be made with regard to the constituent materials of the toner particles.

The toner particles (toner) which constitute the liquid developer according to the present invention contain at least a binder resin (resin material) and a coloring agent.

1. Resin (Binder resin)

Toner particles contained in a liquid developer are constituted from a material which contains a resin (binder resin) as its main component.

In the present invention, there is no specific limitation on the kinds of a resin (binder resin) to be used. Examples of such a resin (binder resins) include styrene-based resins (homopolymers or copolymers containing styrene or a styrene substituent) such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic ester copolymer, styrene-acrylic ester-methacrylic ester copolymer, styrene-α-methyl chloroacrylate copolymer, styrene-acrylonitrile-acrylic ester copolymer, and styrene-vinyl methyl ether copolymer, polyester-based resins, epoxy resins, urethane-modified epoxy resins, silicone-modified epoxy resins, vinyl chloride resins, rosin-modified maleic acid resins, phenyl resins, polyethylene-based resins, polypropylene, ionomer resins, polyurethane resins, silicone resins, ketone resins, ethylene-ethylacrylate copolymer, xylene reins, polyvinyl butyral resins, terpene reins, phenol resins, and aliphatic or alicyclic hydrocarbon resins. These binder resins can be used singly or in combination of two or more of them. Among these resins, in a case where polyester-based resins are used as a main component of toner particles, it is possible to make dispersibility of the toner particles in a liquid developer particularly excellent. This is because polyester-based resins and an insulation liquid which will be described later in detail (in particular, an insulation liquid composed of an ester of glycerin and an unsaturated fatty acid component) have similar chemical structure.

The softening point of the resin (resin material) is not particularly limited to any specific value, but it is preferably in the range of 50 to 130° C., more preferably in the range of 50 to 120° C., and even more preferably in the range of 60 to 115° C. In this specification, the term "softening point" means a temperature at which softening begins under the conditions that a temperature raising speed is 5° C./mim and a diameter of a die hole is 1.0 mm in a high-floored flow tester (manufactured by Shimadzu Corporation).

2. Coloring agent

The toner particles of the liquid developer also contain a coloring agent. As for a coloring agent, pigments, dyes or the like can be used. Examples of such pigments and dyes include Carbon Black, Spirit Black, Lamp Black (C.I. No. 77266), Magnetite, Titanium Black, Chrome Yellow, Cadmium Yellow, Mineral Fast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chalco Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more of them.

3. Other Components

Further, additional components other than the above components may be contained in the toner particles. Examples of such other components include a wax, a charge control agent, a magnetic powder, and the like.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more of them.

Examples of the charge control agent include a metallic salt of benzoic acid, a metallic salt of salicylic acid, a metallic salt of alkylsalicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Further, examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, the constituent material of the kneaded material may further contain zinc stearate, zinc oxide, cerium oxide, silica, titanium oxide, iron oxide, aliphatic acid, or aliphatic metal salt, or the like in addition to the components described above.

The average particle size (diameter) of the toner particles constituted from the above described materials is preferably in the range of 0.1 to 5 μm, more preferably in the range of 0.1 to 4 μm, and even more preferably in the range of 0.5 to 3 μm. If the average particle size of the toner particles is within the above range, it is possible to make resolution of a toner image formed from the liquid developer (liquid toner) sufficiently high.

Furthermore, it is also preferred that an average roundness R represented by the following formula (I) is preferably in the range of 0.94 to 0.99, more preferably in the range of 0.96 to 0.99.

$$R=L_0/L_1 \quad \text{(I)}$$

wherein $L_1$ (μm) represents the circumference of projected image of a toner particle that is a subject of measurement, and $L_0$ (μm) represents the circumference of a perfect circle (a geometrically perfect circle) having the same area as that of the projected image of the toner particle that is a subject of measurement.

When the average roundness R of the toner particles is within the above range, an appropriate amount of the insulation liquid can be contained in the unfixed toner image transferred onto the recording medium, thus making it possible to make the fixing strength of the toner particles higher.

In particular, when $L_2$ represents a length of a toner particle in a long axis direction thereof and $L_3$ represents a length of a toner particle in a short axis direction thereof in two-dimensional view, it is preferred that the relation of $1.00 \leqq L_2/L_3 \leqq 1.40$ is satisfied, and more preferred that the relation of $1.00 \leqq L_2/L_3 \leqq 1.25$ is satisfied. If the length of the toner particle satisfies such a relation, the above-mentioned effect can be exhibited more remarkably.

<Insulation Liquid>

Next, a description will be made with regard to an insulation liquid contained in the liquid developer.

Although an insulation liquid contained in the liquid developer used in the image forming apparatus of the present invention is not particularly limited to any specific one as long as it can be oxidized and polymerized during a fixing process, it is preferred that the insulation liquid contains an unsaturated fatty acid component having an unsaturated bond. If the insulation liquid contains the unsaturated fatty acid component, the oxidation polymerization reaction of the insulation liquid can progress effectively at a relatively low temperature during the fixing process. In particular, the unsaturated fatty acid component is cured by being oxidized at a fixing temperature in the fixing process, whereby improving the fixing characteristics of the toner particles. In addition, since the unsaturated fatty acid component is cured, it is possible to write letters or the like onto a fixed toner image with a ballpoint pen with a water-based ink easily and reliably.

Further, the unsaturated fatty acid component is harmless to the environment. Therefore, it is possible to reduce an adverse effect on the environment caused by leakage of the insulation liquid to the exterior of the image forming apparatus or disposal of the used liquid developer. As a result, it is possible to provide an image forming apparatus that is harmless to the environment.

Further, since the unsaturated fatty acid component has high compatibility with toner particles (with resin materials constituting toner particles), it is possible to improve dispersibility of the toner particles by using the insulation liquid containing the unsaturated fatty acid component. As a result of this, it is possible to prevent precipitation or aggregation of the toner particles in the liquid developer storage section even when the image forming apparatus remains unoperated for a prolonged time.

Examples of unsaturated fatty acid constituting the unsaturated fatty acid component include monounsaturated fatty acids such as oleic acid, palmitoleic acid and ricinoleic acid, polyunsaturated fatty acids such as linoleic acid, α-linolenic acid, γ-linolenic acid, arachidonic acid, docosahexaenoic acid (DHA) and eicosapentaenoic acid (EPA), and the like. These acids can be used singly or in combination of two or more of them.

Among these acids, a conjugated unsaturated fatty acid component is preferably used. Since the conjugated unsaturated fatty acid component has particularly high compatibility with resin materials constituting the toner particles, the dispersibility of the toner particles in the liquid developer can be made particularly high.

Such a conjugated unsaturated fatty acid component is not particularly limited to any specific one as long as it has a conjugated unsaturated bond therein. For example, a conjugated unsaturated fatty acid component which is synthesized, a conjugated unsaturated fatty acid component which is directly extracted from vegetable oils and the like or a conjugated unsaturated fatty acid component which is obtained by conjugating an unsaturated fatty acid component may be used.

Such unsaturated fatty acids as described above can be obtained from naturally derived oils such as vegetable oils, animal oils and the like. Examples of the vegetable oils include castor oil, wood oil, safflower oil, linsheed oil, sunflower oil, corn oil, cotton seed oil, soybean oil, sesame oil, sweet corn oil, hemp oil, evening primrose oil, blackcurrant oil, borage oil and the like while examples of the animal oils include sardine oil, mackerel oil, herring oil, and the like.

The amount of the unsaturated fatty acid component contained in the insulation liquid with respect to the amount of all fatty acid components contained in the insulation liquid is preferably equal to or more than 10 mol %, more preferably equal to or more than 20 mol %, and even more preferably in the range of 20 to 90 mol %. By setting the amount of the unsaturated fatty acid component within such a range, it is possible to accelerate the oxidation polymerization reaction of the insulation liquid more effectively during the fixing process.

Further, the unsaturated fatty acid component may exist in any form in the insulation liquid. For example, the unsaturated fatty acid component may exist as an unsaturated fatty acid, a conjugated unsaturated fatty acid salt or a compound formed together with other components. Examples of such a compound include an ester of an unsaturated fatty acid component and an alcohol component (a multiple alcohol component), an amide of an unsaturated fatty acid component and an amine component (a multiple amine component), and the like. Among these compounds, it is preferred to use an ester, and more preferred to use an ester of glycerin and unsaturated fatty acid (hereinafter, also referred to as "glyceride"). In a case where such an ester is formed in the insulation liquid, it is possible to make preservability and storage stability of the liquid developer and fixing characteristics of the toner particles onto a recording medium particularly excellent.

Further, the insulation liquid may contain a saturated fatty acid component described below other than the above components, for example.

A saturated fatty acid component has a function of maintaining high chemical stability of the liquid developer. Therefore, in a case where the saturated fatty acid component is contained in the insulation liquid, it is possible to prevent chemical alteration of the liquid developer effectively, thus preservability and storage stability of the obtained liquid developer can be made further excellent.

In addition, the saturated fatty acid component has functions of maintaining a high electrical insulation property and high viscosity of the liquid developer. Therefore, in a case where the saturated fatty acid component is contained in the insulation liquid, it is possible to maintain high electrical resistance of the liquid developer. Further, a transport property of the liquid developer can be made particularly excellent due to appropriate viscosity thereof.

Examples of saturated fatty acids constituting such a saturated fatty acid component include butyric acid (C4), caproicacid (C6), caprylicacid (C8), capricacid (C10), lauric acid (C12), myristic acid (C14), palmitic acid (C16), stearin acid (C18), arachic acid (C20), behenic acid (C22), lignocerin acid (C24) and the like. These acids can be used singly or in combination of two or more of them. Among these saturated fatty acids, it is preferred to use one in which carbon number within a molecule is in the range of 6 to 22, more preferred to use one in which carbon number within a molecule is in the range of 8 to 20, even more preferred to use one in which carbon number within a molecule is in the range of 10 to 18. By containing a saturated fatty acid component composed of such saturated fatty acids in the insulation liquid, the above-mentioned effect can be exhibited more remarkably.

The above-mentioned saturated fatty acid component can be obtained effectively from naturally derived oils such as vegetable oils (e.g. palm oil (especially palm kernel oil), coconut oil, coconut oil), animal oils (e.g. butter) and the like.

In a case where the saturated fatty acid component is contained in the insulation liquid, although the amount of the saturated fatty acid component contained in the insulation liquid with respect to the amount of all fatty acid components contained in the insulation liquid is not particularly limited to any specific value, it is preferably in the range of 0.5 to 40 mol %, and more preferably in the range of 1 to 30 mol %. This makes it possible to accelerate the oxidation polymerization reaction of the insulation liquid effectively while maintaining the high electrical insulation property of the insulation liquid.

In a case where the unsaturated fatty acid component and the saturated fatty acid component are contained in the insulation liquid as above, the unsaturated fatty acid component and the saturated fatty acid component may exist in any form in the insulation liquid. For example, in the insulation liquid, each of the unsaturated fatty acid component and the saturated fatty acid component may independently exist as unsaturated fatty acid (or an unsaturated fatty acid salt) and saturated fatty acid (or a saturated fatty acid salt), or may exist as a compound formed together with other components. Examples of such a compound include an ester of an unsaturated fatty acid component, a saturated fatty acid component and an alcohol component (a multiple alcohol component), an amide of an unsaturated fatty acid component, a saturated fatty acid component and an amine component (a multiple amine component), and the like. Among these compounds, it is preferred to use an ester, and more preferred to use an ester of glycerin, an unsaturated fatty acid component and a saturated fatty acid component (hereinafter, also referred to as "glyceride").

In a case where the insulation liquid contains the above-mentioned ester (glyceride), the amount of the ester contained in the insulation liquid is preferably equal to or more than 90 wt %, more preferably equal to or more than 95 wt %, and even more preferably equal to or more than 97 wt %. This makes it possible to considerably reduce an adverse effect on the environment as well as to accelerate the oxidation polymerization reaction of the insulation liquid more effectively during the fixing process.

Furthermore, the liquid developer (insulation liquid) may further contain an antioxidizing agent for preventing or controlling oxidation of the insulation liquid. This makes it possible to prevent the undesirable oxidation of the insulation liquid in the liquid developer storage section of the image forming apparatus.

Examples of such an antioxidizing agent include a vitamin E such as tocopherol, d-tocopherol, d1-α-tocopherol, acetic acid-α-tocopherol, acetic acid d1-α-tocopherol, tocopherol acetate, and α-tocopherol, a vitamin C such as ascorbic acid, ascorbic acid salts (ascorbate), ascorbate stearic acid ester, dibutyl hydroxy toluene, butyl hydroxy anisole, green tea extract, green coffee bean extract, sesamol, sesaminol, and the like. These antioxidizing agents may be used singly or in combination of two or more of them.

Among these substances, when a vitamin E is used, it is possible to obtain the following effects. Namely, a vitamin E is a substance which is harmless to the environment, and its oxidative product produced by oxidation thereof gives only small effects on the liquid developer, and thus it is possible to prevent the undesirable oxidation of the insulation liquid in the liquid developer storage section of the image forming apparatus more effectively. Further, since a vitamin E is a substance having high dispersibility in the above-mentioned liquid containing the unsaturated fatty acid (in particular, glyceride), it can be used as the antioxidizing agent preferably. Furthermore, by using a vitamin E together with the glyceride described above, it is possible to further improve compatibility of toner particles with the insulation liquid, thereby making it possible to further improve the storage stability of the liquid developer and the fixing characteristics of the toner particles onto a recording medium.

Further, among the substances mentioned above, when a vitamin C is used, it is possible to obtain the following effects. Namely, as is the same with the vitamin E described above, a vitamin C is a substance which is harmless to the environment, and its oxidative product produced by oxidation thereof gives only small effects on the liquid developer, and thus it is possible to prevent the undesirable oxidation of the insulation liquid in the liquid developer storage section of the image forming apparatus more effectively. Further, since a vitamin C is a substance having a relatively low pyrolysis temperature, it can exhibit a function as the antioxidizing agent sufficiently during the storage or preservation of the liquid developer while the function as the antioxidizing agent is lowered during the fixing process so that the oxidation polymerization reaction of the insulation liquid can progress more reliably.

Further, it is preferred that the pyrolysis temperature of the antioxidizing agent is lower than the fixing temperature during the fixing process. This makes it possible to prevent deterioration of the insulation liquid during the preservation or storage of the liquid developer more effectively. Further, the antioxidizing agent contained in the insulation liquid adhering to the surfaces of the toner particles is thermally decomposed during the fixing process, whereby enabling the insulation liquid to be cured through the oxidation polymerization reaction effectively. As a result, it becomes possible to make the fixing characteristics of the toner particles onto a recording medium sufficiently excellent.

The pyrolysis temperature of the antioxidizing agent is preferably equal to or lower than 200° C., and more preferably equal to or lower than 180° C. This makes it possible for the antioxidizing agent to exhibit its function sufficiently. Further, it is also possible to improve the fixing strength of the toner particles more effectively.

The amount of the antioxidizing agent contained in the insulation liquid with respect to 100 parts by weight of the insulation liquid is preferably in the range of 0.01 to 15 parts by weight, more preferably in the range of 0.1 to 7 parts by weight, and even more preferably in the range of 1 to 7 parts by weight. This makes it possible to accelerate the oxidation polymerization reaction (curing) of the insulation liquid effectively during the fixing process while preventing the deterioration of the liquid developer caused by the oxidation of the insulation liquid during the preservation or storage of the liquid developer more reliably.

Further, the liquid developer may contain an oxidation polymerization accelerator (curing accelerator) for accelerating the oxidation polymerization reaction (curing reaction) of the insulation liquid described above. This makes it possible to cure the insulation liquid through the oxidation polymerization reaction effectively during the fixing process of the toner particles.

In a case where the liquid developer contains an oxidation polymerization accelerator, it is preferred that the oxidation polymerization accelerator does not substantially accelerate the oxidation polymerization reaction of the insulation liquid during the storage or preservation of the liquid developer whereas it accelerates the oxidation polymerization reaction (curing reaction) of the insulation liquid during the fixing process of the toner particles.

Examples of such an oxidation polymerization accelerator include a substance which has a function of accelerating the oxidation polymerization reaction (curing reaction) of the insulation liquid under application of heat whereas the substance does not accelerate the oxidation polymerization reaction (curing reaction) of the insulation liquid at around room temperature. Namely, a substance in which activation energy for the oxidation polymerization reaction (curing reaction) of the insulation liquid is relatively high can be used as the oxidation polymerization accelerator.

Examples of such a substance include various kinds of metal salts of fatty acids and the like. These substances can be used singly or in combination of two or more of them. By using such an oxidation polymerization accelerator, it is possible to accelerate the oxidation polymerization reaction of the insulation liquid during the fixing process while maintaining the storage stability of the liquid developer during the preservation or storage thereof. In particular, in a case where the insulation liquid contains an unsaturated fatty acid component, since metal salts of fatty acids can accelerate the oxidation polymerization reaction of the unsaturated fatty acid component by supplying oxygen during the fixing process, it is possible to accelerate the oxidation polymerization reaction of the insulation liquid under the application of heat (e.g. during a fixing process) effectively. Therefore, it is possible to accelerate the oxidation polymerization reaction of the insulation liquid more effectively during the fixing process while preventing the oxidation polymerization reaction of the insulation liquid during the preservation or storage of the liquid developer more reliably. Further, since metal salts of fatty acids have higher dispersibility in the liquid containing the unsaturated fatty acid component (in particular, glyceride) described above, it is possible to disperse the metal salts of fatty acids into the insulation liquid homogeneously. With this result, it is possible to accelerate the oxidation polymerization reaction effectively as a whole during the fixing process.

Examples of such metal salts of fatty acids include metal salts of a resin acid (e.g. a cobalt salt, a manganese salt, and a lead salt thereof), metal salts of a linolenic acid (e.g. a cobalt salt, a manganese salt, and a lead salt thereof), metal salts of an octylic acid (e.g. a cobalt salt, a manganese salt, a lead salt, a zinc salt, and a calcium salt thereof), metal salts of a naphthenic acid (e.g. a zinc salt and a calcium salt thereof). These metal salts of fatty acids may be used singly or in combination of two or more of them.

The oxidation polymerization accelerator may be contained in the insulation liquid with being encapsulated. Such an encapsulated oxidation polymerization accelerator does not substantially accelerate the oxidation polymerization reaction of the insulation liquid when the image forming apparatus is in an idle state and the like whereas it accelerates the oxidation polymerization reaction (curing reaction) of the insulation liquid as needed. Namely, it is possible to prevent the oxidation polymerization reaction from being caused during the preservation or storage of the liquid developer more reliably. Further, since the capsules of the oxidation polymerization accelerator are collapsed with a predetermined pressure applied at the fixing process to thereby cause contact between the oxidation polymerization accelerator and the insulation liquid, it is possible to accelerate the oxidation polymerization reaction of the insulation liquid reliably. Further, the use of the encapsulated oxidation polymerization accelerator offers a broader choice of materials for the oxidation polymerization accelerator. In other words, even an oxidation polymerization accelerator having high reactivity (an oxidation polymerization accelerator which can accelerate the oxidation polymerization reaction of the insulation liquid at a relatively low temperature) can be used and it can make the fixing strength of the toner particles onto a recording medium particularly excellent.

In this regard, encapsulation of the oxidation polymerization accelerator can be carried out as follows, for example.

First, an oxidation polymerization accelerator is prepared. Then, the oxidation polymerization accelerator is dissolved with a solvent.

No specific limitation is imposed on the kind of such a solvent as long as the oxidation polymerization accelerator can be dissolved therein. Examples of such solvents include inorganic solvents such as carbon disulfide, and carbon tetrachloride, and organic solvents such as ketone-based solvents (e.g., methyl ethyl ketone (MEK), methyl isopropyl ketone (MIPK), and 2-heptanone), alcohol-based solvents (e.g., pentanol, n-hexanol, 1-octanol, and 2-octanol), ether-based solvents (e.g., diethyl ether, and anisole), aliphatic hydrocarbon-based solvents (e.g., hexane, pentane, heptane, cyclohexane, octane, and isoprene), aromatic hydrocarbon-based solvents (e.g., toluene, xylene, benzene, ethyl benzene, and naphthalene), aromatic heterocyclic compound-based solvents (e.g., furan, and thiophene), halide-based solvents (e.g., chloroform), ester-based solvents (e.g., ethyl acetate, isopropyl acetate, isobutyluuu acetate, and ethyl acrylate), nitrile-based solvents (e.g., acrylonitrile), and nitro-based solvents (e.g., nitromethane and nitroethane). These materials can be used singly or in combination of two or more of them.

Next, porous bodies such as hydrophilic silica, hydrophilic alumina, hydrophilic titanium oxide and the like are added to the thus obtained solution so that the solution is adsorbed by the porous bodies.

Next, the porous bodies adsorbing the solution is mixed with a polyether such as polyethyleneglycol, polypropyleneglycol and the like in a heating state. The mixing ratio of the porous bodies and the polyether is preferably in the rage of about 1:0.5 to 1:10, and more preferably in the range of about 1:1 to 1:5. Further, the temperature at the time when the porous bodies and the polyether are mixed is preferably in the range of 5 to 80° C., and more preferably in the range of 20 to 80° C.

Next, the thus obtained mixture is dispersed into a petroleum carbon hydride sufficiently, and it is then cooled down so that the polyether is settled down on the surfaces of the porous bodies. Consequently, a coating of polyether is formed on the surfaces of the porous bodies.

Then, the petroleum carbon hydride is removed by filtering it to obtain an encapsulated oxidation polymerization accelerator.

The amount of the oxidation polymerization accelerator contained in the insulation liquid is preferably in the range of 0.01 to 15 parts by weight with respect to 100 parts by weight of the insulation liquid, more preferably in the range of 0.05 to 7 parts by weight, and even more preferably in the range of 0.1 to 5 parts by weight. This makes it possible to accelerate the oxidation polymerization reaction of the insulation liquid during the fixing process more reliably while preventing oxidation polymerization reaction from being caused during the preservation or storage of the liquid developer sufficiently.

The electric resistance of the insulation liquid described above at room temperature (20° C.) is preferably equal to or higher than $1\times10^{9}$ Ωcm, more preferably equal to or higher than $1\times10^{11}$ Ωcm, and even more preferably equal to or higher than $1\times10^{13}$ Ωcm.

Further, the dielectric constant of the insulation liquid is preferably equal to or lower than 3.5.

Furthermore, in a case where an unsaturated fatty acid component is contained in the insulation liquid, the iodine value of the insulation liquid is preferably in the range of 50 to 200, and more preferably in the range of 60 to 190. This makes it possible to accelerate the oxidation polymerization reaction of the insulation liquid effectively while preventing the chemical deterioration of the insulation liquid sufficiently and also makes it possible to improve the fixing strength of the toner particles when they are fixed onto a recording medium.

<Method for Producing Liquid Developer>

The liquid developer used in the image forming apparatus of the present invention may be obtained using any methods. For example, it can be obtained using a method in which a liquid developer is prepared using a dispersion liquid in which materials constituting toner particles are dispersed (a method described in Japanese Patent Application No. 2004-370231).

Although the image forming apparatus according to the present invention has been described based on the preferred embodiments hereinabove, the present invention is not limited thereto.

For example, each component constituting the image forming apparatus of the present invention may be replaced by one which can exhibit the same function. Alternatively, other components may also be added thereto.

Further, the liquid developer used in the image forming apparatus of the present invention is not limited to the one prepared using the above-mentioned method and it may be prepared using any other methods.

EXAMPLE

(1) Production of Liquid Developer

Example 1

[Production of Dry Fine Particles]

First, 80 parts by weight of a polyester resin (softening point $T_f$: 124° C.) as a binder resin and 20 parts by weight of a cyanine pigment ("Pigment Blue 15:3", manufactured by Dainichiseika Color & Chemicals Mfg. Co., Ltd.) as a coloring agent were prepared.

These components were mixed and kneaded using a 20 L type Henschel mixer to obtain a kneaded material.

The thus obtained kneaded material was coarsely ground using a hammer mil so as to be formed into powder (ground material) having an average particle size of 1.5 mm.

Next, 250 parts by weight of toluene was added to 100 parts by weight of the coarse ground kneaded material, and it was then subjected to a treatment using an ultrasound homogenizer (output: 400 μA) for one hour to thereby obtain a solution in which the polyester resin of the kneaded material was dissolved. In the solution, the pigment was finely dispersed homogeneously.

Further, 1 part by weight of sodium-dodecylbenzenesulfonic acid as a dispersant was mixed with 700 parts by weight of ion-exchanged water to obtain a water-based liquid.

The water-based liquid was stirred with a homomixer (PRIMIX Corporation) with the number of stirring being adjusted.

The above-mentioned solution (that is, the toluene solution of the kneaded material) was dropped in the water-based liquid which is being stirred, to thereby obtain a water-based emulsion in which a dispersoid comprised of particles having an average particle size of 3 μm was homogeneously dispersed.

Thereafter, the toluene in the water-based emulsion was removed under the conditions that a temperature was 100° C. and an ambience pressure was 80 kPa, and it was then cooled down to room temperature. Then, predetermined amount of water was added thereto so that the concentration thereof was adjusted to thereby obtain a water-based suspension in which solid fine particles were dispersed. In the thus obtained water-based suspension, substantially no toluene remained. The concentration of the solid component (dispersoid) of the thus obtained water-based suspension was 28.8 wt %. Further, the average particle size of the particles of the dispersoid (solid fine particles) dispersed in the suspension was 1.2 μm. The measurement of the average particle size was carried out using a laser diffraction/scattering type particle size distribution measurement apparatus ("LA-920" which is a product name of HORIBA Ltd.).

The thus obtained suspension was filtrated and then dried using an oven at 50° C. to thereby obtain dry fine particles. The average roundness of the dry fine particles was 0.95. Further, when $L_2$ represents a length of the dry fine toner particle in a long axis direction thereof and $L_3$ represents a length of the dry fine toner particle in a short axis direction thereof in two-dimensional view, $L_2/L_3$ was 1.01.

[Encapsulation of Oxidation Polymerization Accelerator]

An encapsulated oxidation polymerization accelerator was prepared in the following manner.

First, 10 g of octylic acid zinc as an oxidation polymerization accelerator was dissolved in 15 ml of acetone, and the thus obtained solution was adsorbed by a porous hydrophilic silica gel to thereby obtain core bodies. Then, 10 g of the thus obtained core bodies and 20 g of polyethylene glycol (PEG) were mixed in a heating state to thereby obtain a mixture thereof. Thereafter, the mixture was put into 400 ml of a solvent (AF6: Product of NIPPON OIL CORPORATION), and it was sufficiently dispersed in the solvent using a homomixer, then it was gradually cooled down so that PEG is settled down. Then, the solvent was removed by a filtering member to thereby obtain an oxidation polymerization accelerator with being encapsulated.

[Preparation of Insulation Liquid]

An insulation liquid containing an unsaturated fatty acid component was prepared as described below.

Firstly, castor oil was roughly refined by a low-temperature crystal method using methanol, diethyl ether, petroleum ether, acetone or the like as a solvent.

Next, 300 parts by volume of the roughly refined castor oil (the first roughly refined oil) was put into a flask. After that, 100 parts by volume of boiled water was poured into the flask, and the flask was then plugged.

Next, the flask was shaken so that the roughly refined castor oil (the first roughly refined oil) and the boiled water were mixed. Then, the flask had been left until a mixed solution therein was separated into three layers. After it was confirmed that the mixed solution was completely separated into three layers, the flask was put in a freezer and left for 24 hours. Subsequently, an unfrozen component in the mixed solution was taken out and put into a second flask, and the unfrozen component was again subjected to the same operation as described above. Then, an unfrozen component was taken out from the second flask to obtain a roughly refined fatty oil (the second roughly refined oil).

Then, 100 parts by volume of the thus obtained roughly refined fatty oil (the second roughly refined oil) and 35 parts by volume of an activated earth mainly composed of hydrous silicic aluminum were put in a flask and they were mixed and stirred.

Thereafter, the thus obtained mixture was being left for 48 hours under a pressure of 0.18 Mpa so that the activated earth was completely settled down. Then, the precipitation thereof was removed to thereby obtain a liquid containing a ricinoleic acid component as an unsaturated fatty acid component (a liquid mainly composed of a ricinoleic acid glyceride, hereinafter also referred to as "a ricinoleic acid glyceride solution").

Next, 15 parts by weight of sulfuric acid was added to 100 parts by weight of the thus obtained ricinoleic acid glyceride solution and they were reacted for two hours with being heated at a temperature of 120 to 150° C.

Next, the sulfuric acid was removed from the thus reacted solution by washing with water and it was then dehydrated under reduced pressure under the condition that a temperature was 110° C. and a reduced pressure degree was 10 mmHg to thereby obtain a liquid containing a conjugated linoleic acid component (a conjugated unsaturated fatty acid component) (hereinafter also referred to as "a conjugated linoleic acid glyceride solution").

Next, palm kernel oil was roughly refined by a low-temperature crystal method using methanol, diethyl ether, petroleum ether, acetone or the like as a solvent.

Next, 300 parts by volume of the roughly refined palm kernel oil was put into a flask. After that, 100 parts by volume of boiled water was poured into the flask, and the flask was then plugged.

Next, the flask was shaken so that the roughly refined palm kernel oil and the boiled water were mixed. Then, the flask had been left until a mixed solution therein was separated into three layers. After it was confirmed that the mixed solution was completely separated into three layers, the flask was put in a freezer and left for 24 hours. Subsequently, a frozen component in the mixed solution was separated and repeatedly subjected to the same operation as described above three times. In this way, a liquid containing a saturated fatty acid component (a liquid mainly composed of saturated fatty acid glyceride, also referred to as "a saturated fatty acid component solution") was obtained.

Then, 470 parts by weight of the conjugated linoleic acid glyceride solution, 30 parts by weight of the saturated fatty acid component solution and 5 parts by weight of α-tocopherol (vitamin E; pyrolysis temperature is equal to or more than 300° C.) as an antioxidizing agent were mixed to thereby obtain an insulation liquid.

In this regard, the amount of the conjugated linoleic acid component contained in the insulation liquid with respect to the amount of all fatty acid components contained in the insulation liquid was 42 mol %. Further, the electric resistance of the thus obtained insulation liquid at room temperature (20° C.) was $6.0\times10^{14}$ Ωcm.

[Dispersion of Dry Fine Particles and Oxidation Polymerization Accelerator]

505 parts by weight of the thus obtained insulation liquid, 1 part by weight of dodecyltrimethylammonium chloride as a surfactant, 1.25 parts by weight of the encapsulated oxidation polymerization accelerator (1 part by weight of the oxidation polymerization accelerator excluding a capsule part), and 75 parts by weight of the dry fine particles were mixed with being stirred with a homomixer (PRIMIX Corporation) for 10 minutes to thereby obtain a liquid developer.

Example 2

A liquid developer was prepared in the same manner as in the Example 1 except that the insulation liquid was prepared in accordance with the following manner.

Firstly, wood oil was subjected to the same process as in the Example 1 to thereby obtain a glyceride solution containing a conjugated unsaturated fatty acid component.

Next, palm kernel oil was roughly refined by a low-temperature crystal method using methanol, diethyl ether, petroleum ether, acetone or the like as a solvent.

Next, 300 parts by volume of the roughly refined palm kernel oil was put into a flask. After that, 100 parts by volume of boiled water was poured into the flask, and the flask was then plugged.

Next, the flask was shaken so that the roughly refined palm kernel oil and the boiled water were mixed. Then, the flask had been left until a mixed solution therein was separated into three layers. After it was confirmed that the mixed solution was completely separated into three layers, the flask was put in a freezer and left for 24 hours. Subsequently, a frozen component in the mixed solution was separated and repeatedly subjected to the same operation as described above three times. In this way, a liquid containing a saturated fatty acid component (a liquid mainly composed of saturated fatty acid glyceride, also referred to as "a saturated fatty acid component solution") was obtained.

Then, 470 parts by weight of the glyceride solution, 30 parts by weight of the saturated fatty acid component solution and 5 parts by weight of α-tocopherol as an antioxidizing agent were mixed to thereby obtain an insulation liquid.

In this regard, the amount of a conjugated linoleic acid component contained in the insulation liquid with respect to the amount of all fatty acid components contained in the insulation liquid was 72 mol %. Further, the electric resistance of the thus obtained insulation liquid at room temperature (20° C.) was $6.0\times10^{14}$ Ωcm.

Examples 3 to 5

In each of the Examples 3 to 5, a liquid developer was prepared in the same manner as in the Example 1 except that the amount of the conjugated unsaturated fatty acid component contained in the insulation liquid with respect to the amount of all fatty acid components contained in the insulation liquid was changed as shown in Table 1 by adjusting the amount of the sulfuric acid to be added to the ricinoleic acid glyceride solution and the reaction time of the ricinoleic acid glyceride solution and the sulfuric acid, and the like.

Example 6

A liquid developer was prepared in the same manner as in the Example 1 except that the insulation liquid was prepared in the following manner.

Firstly, sardine oil was roughly refined by a low-temperature crystal method using methanol, diethyl ether, petroleum ether, acetone or the like as a solvent.

Next, 300 parts by volume of the roughly refined sardine oil (the first roughly refined oil) was put into a flask. After that, 100 parts by volume of boiled water was poured into the flask, and the flask was then plugged.

Next, the flask was shaken so that the roughly refined sardine oil (the first roughly refined oil) and the boiled water were mixed. Then, the flask had been left until a mixed solution therein was separated into three layers. After it was confirmed that the mixed solution was completely separated into three layers, the flask was put in a freezer and left for 24 hours. Subsequently, an unfrozen component in the mixed solution was taken out and put into a second flask, and the unfrozen component was again subjected to the same operation as described above. Then, an unfrozen component was taken out from the second flask to thereby obtain a roughly refined fatty oil (the second roughly refined oil).

Then, 100 parts by volume of the thus obtained roughly refined fatty oil (the second roughly refined oil) and 35 parts by volume of an activated earth mainly composed of hydrous silicic aluminum were put in a flask and they were mixed with being stirred.

Thereafter, the thus obtained mixture was being left for 48 hours under a pressure of 0.18 MPa so that the activated earth was completely settled down. Then, the precipitation thereof was removed to thereby obtain a liquid containing an eicosapentaenoic acid component (a liquid mainly composed of an eicosapentaenoic acid glyceride). In the thus obtained liquid (hereinafter, also referred to as "eicosapentaenoic acid glyceride solution"), a double bond in the eicosapentaenoic acid which is a main component of the eicosapentaenoic acid glyceride was not conjugated.

Next, 50 parts by weight of potassium hydroxide was dissolved in 150 parts by weight of ethylene glycol, and the thus obtained solution was subjected to nitrogen bubbling so that the temperature of the solution was increased up to 110° C. Then, 100 parts by weight of a nonconjugated eicosapentaenoic acid glyceride solution was added thereto and they were reacted under nitrogen gas stream at a temperature of 110° C. for 2.5 hours. Then, the thus reacted solution was cooled down to room temperature and hydrochloric acid was added thereto so that the solution became neutral, and further, it was stirred for 15 minutes. Subsequently, pH of the solution was adjusted to 3 and it was then stirred for 5 minutes with distilled water added thereto.

Next, the solution was subjected to hexane extraction three times, and a hexane solution was cleaned with a 5 wt % of sodium chloride solution and distilled water, and then subjected to dewatering filtration. After that, hexane was distilled away to thereby obtain a liquid mainly composed of conjugated eicosapentaenoic acid glyceride (conjugated unsaturated fatty acid glyceride) (conjugated eicosapentaenoic acid glyceride solution).

Then, 470 parts by weight of the eicosapentaenoic acid glyceride solution, 30 parts by weight of the saturated fatty acid component solution and 5 parts by weight of α-tocopherol as an antioxidizing agent were mixed to thereby obtain an insulation liquid.

In this regard, the amount of a conjugated eicosapentaenoic acid component contained in the insulation liquid with respect to the amount of all fatty acid components contained in the insulation liquid was 43 mol %. Further, the electric resistance of the thus obtained insulation liquid at room temperature (20° C.) was $6.0\times10^{14}$ Ωcm.

Examples 7 and 8

In each of the Examples 7 and 8, a liquid developer was prepared in the same manner as in the Example 1 except that the binder resin was changed to one shown in the Table 1 in the preparation of the kneaded material, and each of the amounts of the conjugated unsaturated fatty acid component, the saturated fatty acid component, the antioxidizing agent and the oxidation polymerization accelerator contained in the liquid developer was changed as shown in the Table 1.

Example 9

A liquid developer was prepared in the same manner as in the Example 8 except that ascorbic acid (vitamin C; pyrolysis temperature is equal to or less than 50° C.) was used as the antioxidizing agent.

Example 10

A liquid developer was prepared in the same manner as in the Example 2 except that octylic acid zinc which was not encapsulated was used as the oxidation polymerization accelerator.

Example 11

A liquid developer was prepared in the same manner as in the Example 2 except that no oxidation polymerization accelerator was used.

Example 12

A liquid developer was prepared in the same manner as in the Example 2 except that neither oxidation polymerization accelerator nor antioxidizing agent was used.

Comparative Example 1

A liquid developer was prepared in the same manner as in the Example 11 except that ISOPER G which cannot be oxidized and polymerized was used as the insulation liquid.

Comparative Example 2

A liquid developer was prepared in the same manner as in the Example 11 except that silicone oil which cannot be oxidized and polymerized was used as the insulation liquid.

The conditions for producing the liquid developers of the Examples 1 to 12 and the Comparative Examples 1 and 2 are shown in the following Table 1.

In this connection, it is to be noted that in the Table 1, the kinds of the fatty acids, the antioxidizing agents and the oxidation polymerization accelerator used are represented by the following abbreviations.

PEs: polyester resin
EP: epoxy resin
St-Ac: styrene-acrylic copolymer
LN: linoleic acid
EPA: eicosapentaenoic acid
CA: capric acid
LA: lauric acid
MY: myristic acid
PA: palmitic acid
ST: stearic acid
O—Zn: octylic acid zinc
VE: α-tocopherol
VC: ascorbate stearic acid

TABLE 1

| | resin material | | insulation liquid: glyceride | | | | antioxidizing agent | | | | | oxidation polymerization accelerator | | |
|---|---|---|---|---|---|---|---|---|---|---|---|---|---|---|
| | kind | softening point [° C.] | unsaturated fatty acid component | saturated fatty acid component | **U [mol %] | ***S [mol %] | kind | pyrolysis temperature [° C.] | *****amount [parts by weight] | electric resistance [Ωcm] | iodine value | kind | ****EC | *****amount [parts by weight] |
| Ex. 1 | PEs | 124 | *C-LN | CA, LA, MY, PA, ST | 42 | 8 | VE | 300≦ | 3.0 | $6.0 \times 10^{14}$ | 135 | O—Zn | Yes | 1.0 |
| Ex. 2 | PEs | 124 | *C-LN | CA, LA, MY, PA, ST | 72 | 8 | VE | 300≦ | 3.0 | $6.0 \times 10^{14}$ | 135 | O—Zn | Yes | 1.0 |
| Ex. 3 | PEs | 124 | *C-LN | CA, LA, MY, PA, ST | 32 | 8 | VE | 300≦ | 3.0 | $6.3 \times 10^{14}$ | 138 | O—Zn | Yes | 1.0 |
| Ex. 4 | PEs | 124 | *C-LN | CA, LA, MY, PA, ST | 51 | 8 | VE | 300≦ | 3.0 | $6.1 \times 10^{14}$ | 142 | O—Zn | Yes | 1.0 |
| Ex. 5 | PEs | 124 | *C-LN | CA, LA, MY, PA, ST | 26 | 8 | VE | 300≦ | 3.0 | $6.3 \times 10^{14}$ | 139 | O—Zn | Yes | 1.0 |
| Ex. 6 | PEs | 124 | *C-EPA | CA, LA, MY, PA, ST | 43 | 13 | VE | 300≦ | 3.0 | $6.0 \times 10^{14}$ | 139 | O—Zn | Yes | 1.0 |
| Ex. 7 | EP | 128 | *C-LN | CA, LA, MY, PA, ST | 42 | 8 | VE | 300≦ | 3.0 | $6.0 \times 10^{14}$ | 140 | O—Zn | Yes | 1.0 |
| Ex. 8 | St-Ac | 125.6 | *C-LN | CA, LA, MY, PA, ST | 42 | 8 | VE | 300≦ | 3.0 | $6.0 \times 10^{14}$ | 140 | O—Zn | Yes | 5.0 |
| EX. 9 | St-Ac | 125.6 | *C-LN | CA, LA, MY, PA, ST | 42 | 8 | VC | 50≧ | 3.0 | $6.0 \times 10^{14}$ | 140 | O—Zn | Yes | 5.0 |
| Ex. 10 | PEs | 124 | *C-LN | CA, LA, MY, PA, ST | 42 | 8 | VE | 300≦ | 3.0 | $6.0 \times 10^{14}$ | 140 | O—Zn | No | 1.0 |
| Ex. 11 | PEs | 124 | *C-LN | CA, LA, MY, PA, ST | 42 | 8 | VE | 300≦ | 3.0 | $6.0 \times 10^{14}$ | 140 | — | — | — |
| Ex. 12 | PEs | 124 | *C-LN | CA, LA, MY, PA, ST | 42 | 8 | — | — | — | $6.0 \times 10^{14}$ | 140 | — | — | — |
| Com. Ex. 1 | PEs | 124 | — | — | — | — | — | — | — | $6.2 \times 10^{15}$ | — | — | — | — |
| Com. Ex. 2 | PEs | 124 | — | — | — | — | — | — | — | $5.0 \times 10^{14}$ | — | — | — | — |

*C—conjugated
**U- amount of unsaturated fatty acid component with respect to all fatty acids
***S- amount of saturated fatty acid component with respect to all fatty acids
****EC—encapsulated or not
*****amount- amount with respect to 100 parts by weight of insulation liquid (2) Evaluation For the respective liquid developers obtained as described above, fixing strength was evaluated.

(2.1) Fixing Strength (Fixing Characteristics)

By using the image forming apparatus shown in FIG. 1, images having a predetermined pattern were formed on recording papers (High quality paper LPCPPA4 produced by Seiko Epson Corporation) employing the liquid developers of the Examples 1 to 12 and the Comparative Examples 1 and 2, respectively. Then, the images formed on the papers were fixed onto the papers at a fixing temperature of 180° C.

Thereafter, the fixed image on each of the papers was rubbed out twice using a sand eraser ("LION 261-11", product of LION OFFICE PRODUCTS CORP.) with a pressure loading of 1.0 kgf. Then, the residual rate of the image density of each recording paper was measured by a colorimeter "X-Rite model 404" (X-Rite Incorporated), and the measurement results were evaluated according to the following five criteria.

AA: Residual rate of the image density was 95% or higher.

A: Residual rate of the image density was 90% or higher but lower than 95%.

B: Residual rate of the image density was 80% or higher but lower than 90%.

C: Residual rate of the image density was 70% or higher but lower than 80%.

D: Residual rate of the image density was lower than 70%.

These results are shown in the following Table 2 together with the average roundness R and $L_2/L_3$. In this connection, it is to be noted that the roundness R was measured by the use of a flow system particle image analyzer (FPIA-2000, manufactured by SYSMEX CORPORATION). The roundness R was determined by the following formula (I):

$$R=L_0/L_1 \quad (I)$$

where $L_1$ (μm) represents the circumference of projected image of a particle that is a subject of measurement, and $L_0$ (μm) represents the circumference of a perfect circle having the same area as that of the projected image of the particle that is a subject of measurement.

(2.2) Printing Speed

By using the liquid developers obtained in the Examples 1 to 12 and the Comparative Examples 1 and 2, printing operations were carried out with the image forming apparatus whose fixing temperature was set to 180° C. In this condition, a printing speed for fixing a toner image at which letters or the like can be written onto the fixed toner image sufficiently with a ballpoint pen with a water-based ink was measured for the respective liquid developer. Further, a printing speed was measured for the respective liquid developer in the same manner as above except that an ultraviolet irradiation means for irradiating ultraviolet ray to the transferred image on the recording medium is provided.

TABLE 2

| | average roundness R | $L_2/L_3$ | average particle size [μm] | Evaluation: fixing strength | Evaluation: printing speed [sheet/min] without UV | Evaluation: printing speed [sheet/min] with UV |
|---|---|---|---|---|---|---|
| Ex. 1 | 0.95 | 1.01 | 1.4 | AA | 30 | 40 |
| Ex. 2 | 0.96 | 1.01 | 1.4 | AA | 50 | 60 |
| Ex. 3 | 0.95 | 1.01 | 1.4 | A | 30 | 40 |
| Ex. 4 | 0.95 | 1.01 | 1.4 | AA | 30 | 40 |
| Ex. 5 | 0.95 | 1.01 | 1.4 | A | 30 | 40 |
| Ex. 6 | 0.97 | 1.01 | 1.4 | AA | 30 | 40 |
| Ex. 7 | 0.97 | 1.01 | 1.4 | A | 30 | 40 |
| Ex. 8 | 0.95 | 1.01 | 1.6 | A | 30 | 40 |
| Ex. 9 | 0.95 | 1.01 | 1.6 | AA | 30 | 40 |
| Ex. 10 | 0.96 | 1.01 | 1.2 | A | 30 | 40 |
| Ex. 11 | 0.97 | 1.01 | 1.4 | A | 25 | 30 |
| Ex. 12 | 0.97 | 1.01 | 1.4 | A | 25 | 30 |
| Com. Ex. 1 | 0.97 | 1.01 | 1.4 | D | 10 | 10 |
| Com. Ex. 2 | 0.97 | 1.01 | 1.4 | D | 10 | 10 |

As shown in Table 2, the liquid developers of the present invention in which oxidation polymerization reaction of the insulation liquid was utilized had excellent fixing strength. In contrast, in the liquid developers of the Comparative Examples, satisfactory results could not be obtained. Further, when the fixing strength of the respective liquid developers was evaluated in the same manner as described above except that the fixing temperature was changed to 160° C., 140° C., 120° C., 100° C. and 80° C., the same results could be obtained.

Finally, it is to be noted that the present invention is not limited to the embodiments and the examples described above, and many additions and modifications may be made without departing from the spirit of the present invention which are defined by the following claims.

What is claimed is:

1. A method for forming an image onto a recording medium comprising:

preparing a liquid developer containing an insulation liquid and toner particles dispersed in the insulation liquid;

storing the liquid developer in a liquid developer container;

forming an electrostatic latent image onto a photoreceptor;

developing the electrostatic latent image formed on the photoreceptor using the liquid developer supplied from the liquid developer container to form a toner image on the photoreceptor;

transferring the toner image formed on the photoreceptor onto a recording medium; and fixing the toner image transferred on the recording medium onto the recording medium, wherein at least a part of the insulation liquid in the transferred toner image is oxidized and polymerized by heating the transferred toner image and irradiating it with ultraviolet rays during the fixing process to fix the toner particles in the transferred toner image onto the recording medium.

2. The method as claimed in claim 1, wherein the insulation liquid constituting the liquid developer contains an unsaturated fatty acid component.

3. The method as claimed in claim 1, wherein the liquid developer contains an oxidation polymerization accelerator that accelerates oxidation polymerization reaction of the insulation liquid during the fixing process.

4. The method as claimed in claim 3, wherein the oxidation polymerization accelerator is contained in the insulation liquid with being encapsulated.

5. The method as claimed in claim 1, wherein the liquid developer contains an antioxidizing agent.

6. The image forming apparatus as claimed in claim 5, wherein a pyrolysis temperature of the antioxidizing agent is equal to or lower than a fixing temperature of the fixing process.

* * * * *